US006951490B2

(12) United States Patent
De Faria et al.

(10) Patent No.: US 6,951,490 B2
(45) Date of Patent: Oct. 4, 2005

(54) APPARATUS, METHODS AND ARTICLES OF MANUFACTURE FOR AN ADJUSTABLE PIN HEADER ASSEMBLY

(75) Inventors: Pedro Lamartine De Faria, Braganca Paulista (BR); Elias Gomes De Oliveira, Braganca Paulista (BR)

(73) Assignee: Tyco Eletro-Electronica LTDA (BR)

( * ) Notice: Subject to any disclaimer, the term of this patent is extended or adjusted under 35 U.S.C. 154(b) by 0 days.

(21) Appl. No.: 10/621,728

(22) Filed: Jul. 17, 2003

(65) Prior Publication Data

US 2004/0077229 A1 Apr. 22, 2004

Related U.S. Application Data

(60) Provisional application No. 60/413,377, filed on Sep. 25, 2002.

(51) Int. Cl.[7] ..... H01R 9/22
(52) U.S. Cl. ..... 439/717
(58) Field of Search ..... 439/717, 594, 439/701, 710, 712–713, 715, 246–248

(56) References Cited

U.S. PATENT DOCUMENTS

| | | | | | |
|---|---|---|---|---|---|
| 3,673,545 | A | | 6/1972 | Rundle | 339/64 M |
| 4,550,959 | A | * | 11/1985 | Grabbe et al. | 439/717 |
| 4,580,861 | A | * | 4/1986 | Kaley | 439/594 |
| 4,790,763 | A | * | 12/1988 | Weber et al. | 439/717 |
| 5,295,870 | A | * | 3/1994 | Rei et al. | 439/717 |
| 5,443,404 | A | * | 8/1995 | Matsuoka | 439/717 |
| 5,622,511 | A | | 4/1997 | Jarrett | 439/248 |
| 6,332,813 | B1 | * | 12/2001 | Okabe et al. | 439/701 |
| 6,343,959 | B2 | * | 2/2002 | Sato | 439/701 |

* cited by examiner

*Primary Examiner*—Tho D. Ta
*Assistant Examiner*—Felix O. Figueroa

(57) ABSTRACT

A moveable pin header assembly including a first header with a retention arm, and a second header with an opening for receiving the retention arm. The retention arm may be securely fastened within the opening, but may move longitudinally therein.

19 Claims, 8 Drawing Sheets

APPARATUS, METHODS AND ARTICLES OF MANUFACTURE FOR AN ADJUSTABLE PIN HEADER ASSEMBLY

CROSS-REFERENCE TO RELATED APPLICATIONS

The present application claims the priority of U.S. Provisional Application Ser. No. 60/413,377, filed on Sep. 25, 2002, which is herein incorporated in its entirety by reference.

FIELD OF THE INVENTION

The present invention relates generally to connectors and more particularly to connectors for printed circuit boards.

BACKGROUND OF THE INVENTION

Printed circuit boards ("PCB") can have various circuit elements and paths formed therein. Additional periphery (i.e., components, connections to other PCBS, devices, power sources, etc.) may be connected directly to the PCB utilizing vias, which are holes having conductive material. Some periphery, however, may not be able to utilize the vias in order to connect to the PCBs and instead need to utilize headers. A header is basically a device that is connected to a PCB and includes terminals (pins) along the bottom that are used to connect to the vias. The top of the header is designed to house the periphery. The header also includes connections between appropriate portions (i.e., contacts, pins) of the periphery to the terminals that connect to the appropriate vias.

Many PCBs are designed so that the sections of the PCB requiring headers are grouped together in close proximity to each other, normally on one or more edges of the PCB. The reason for the headers being grouped together in close proximity to each other is so that they can be easily assembled to the PCB without impact to the other sections of the PCB. In many instances, all or a majority of the headers for a particular PCB are assembled to the PCB at the same time. Often, the headers are connected to the PCB using automated equipment. Thus, the assembler will desire that all of the headers be connected together in some fashion to form a header assembly.

Prior art header assemblies are formed by injecting all the headers that make up the assembly together as a single unit. Some of the prior art header assemblies utilize a rigid link (i.e., non-conductive frame) between each of the individual headers that make up the header assembly. However, the use of a rigid link does not allow for any adjustment or movement of the pins and thus does not provide for even the slightest offset in dimensions (i.e., error in fabrication of the header assembly or PCB, or malformation of the header assembly during transport). A slight offset in any portion of the header assembly (or PCB) could render the entire assembly useless, as there is no flexibility in the header assembly to allow an assembler to adjust the header assembly to fit in the PCB. Moreover, a rigid link may be susceptible to stresses during assembly and possibly break.

To accommodate for the deficiencies in the rigid link header assemblies, some prior art adjustable pin header assemblies utilize a flexible link between headers in order to provide for movement of the pins in each header with respect to the other headers. FIG. 1 illustrates an exemplary prior art adjustable pin header assembly 100. The header assembly 100 includes headers 110, 120, 130. Small flexible bars (flexible links) 140 are used for linking the various headers 110–130, which are then injected together as a unit to form the adjustable pin header assembly 100. The small flexible bars 140 provide the assembler with some flexibility (i.e., adjustment between headers) in assembling the header assembly 100 to the PCB. However, the headers 110–130 and/or the links 140 can be damaged or broken during handling and loading, often resulting with the complete assembly 100 needing to be scrapped.

In view of the foregoing, it would be advantageous if each of the headers that make up a header assembly could be injected and loaded with terminals separately. The individual headers could then be joined to each other at a later time, before shipment, which would permit better production rationalization and flexibility.

SUMMARY OF THE INVENTION

The present invention is directed to an apparatus, methods and articles of manufacture for an adjustable pin header assembly. An exemplary adjustable pin header assembly includes a plurality of headers independently fabricated. Each header is fabricated to include a connection mechanism formed therein. When a connection mechanism from one header is engaged with a connection mechanism from another header, the headers are moveably attached to each other (i.e., the headers can move longitudinally with respect to one another).

According one embodiment, each housing is preferably injected, handled, stored and loaded separately, and only later the individual headers are assembled in sets for shipment and/or automatic assembly to a (PCB).

According to one embodiment, a first header includes a female connection mechanism and a second header includes a male connection mechanism. The mechanisms allow for movement of the male within the female so as to provide for pin adjustment in the assembly of the header to a PCB.

According to one embodiment, a first header includes a retention arm extending therefrom. The retention arm having a ridge formed proximate to an end. A second header has an opening formed therein for accepting the retention arm. The opening also has a ridge formed therein. The retention arm is inserted in the opening until the ridge of the retention arm passes the ridge of the opening. The two ridges engage one another so as to maintain the connection thereof. The retention arm can move longitudinally therein from a point where the ridges engage to a point where the retention arm abuts the end of the opening.

According to one embodiment, the headers also include alignment mechanisms to assist in aligning and connecting the headers to each other. According to one embodiment, each of the headers includes guide pins to assist in the connection of the header assembly to the PCB.

BRIEF DESCRIPTION OF THE FIGURES

The accompanying drawings, which are incorporated in and form a part of the specification, illustrate the embodiments of the present invention and, together with the description serve to explain the principles of the invention.

In the drawings.

DETAILED DESCRIPTION

Figure 1:
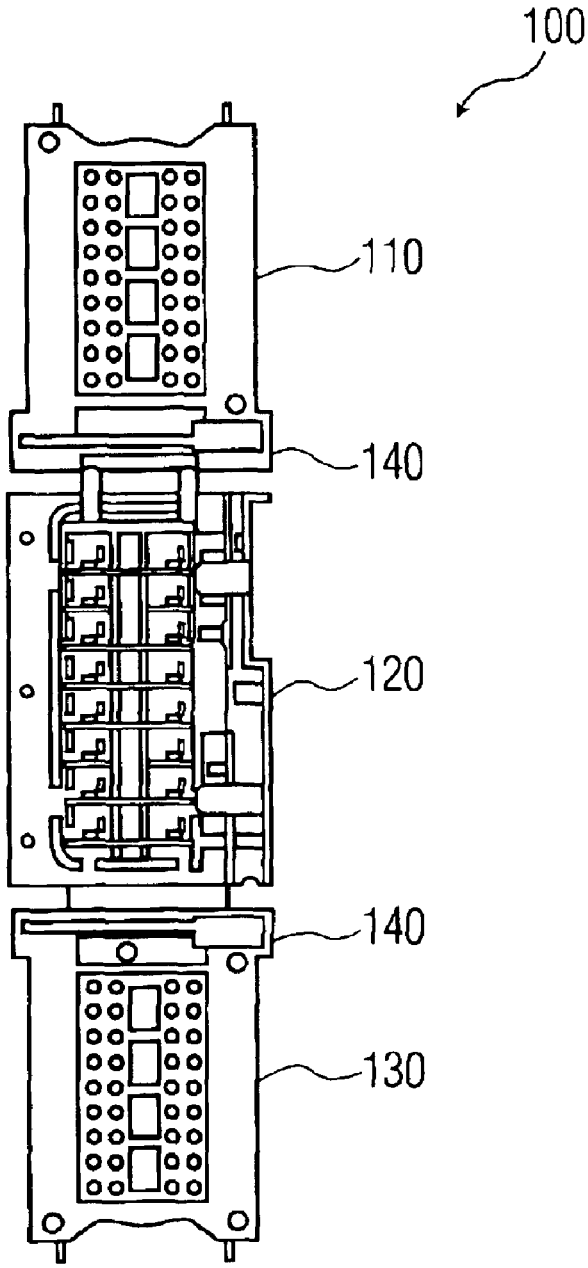
FIG. 1 PRIOR ART
FIG. 1 illustrates a prior art adjustable pin header assembly utilizing flexible links between headers.

Referring now to the drawings in detail, wherein like reference numerals indicate like elements throughout the several views, there is illustrated in FIGS. 2–12 various embodiments generally directed to connectors and more particularly to connectors for printed circuit boards (PCBs).

A moveable pin header assembly in accordance with various embodiments of the present invention is comprised of a plurality of independently fabricated headers. Each of the headers is designed and fabricated to be mounted on a PCB, receive periphery (i.e., connector, component), and to provide connectivity between the periphery and the PCB. Furthermore, each of the headers is designed and fabricated to connect to at least one other header. The connection between the headers is designed to securely hold the headers together in alignment while at the same time providing a relatively small tolerance of movement with respect to each other in a longitudinal direction. The fabrication of each header includes the steps of mold injecting a housing of the header and inserting pins into the housings. As one skilled in the art will recognize, the housing is preferably comprised of a non-conductive material, such as plastic, and the pins are comprised of a conductive material, such as copper, to provide connectivity between the periphery and the PCB.

Figure 2:
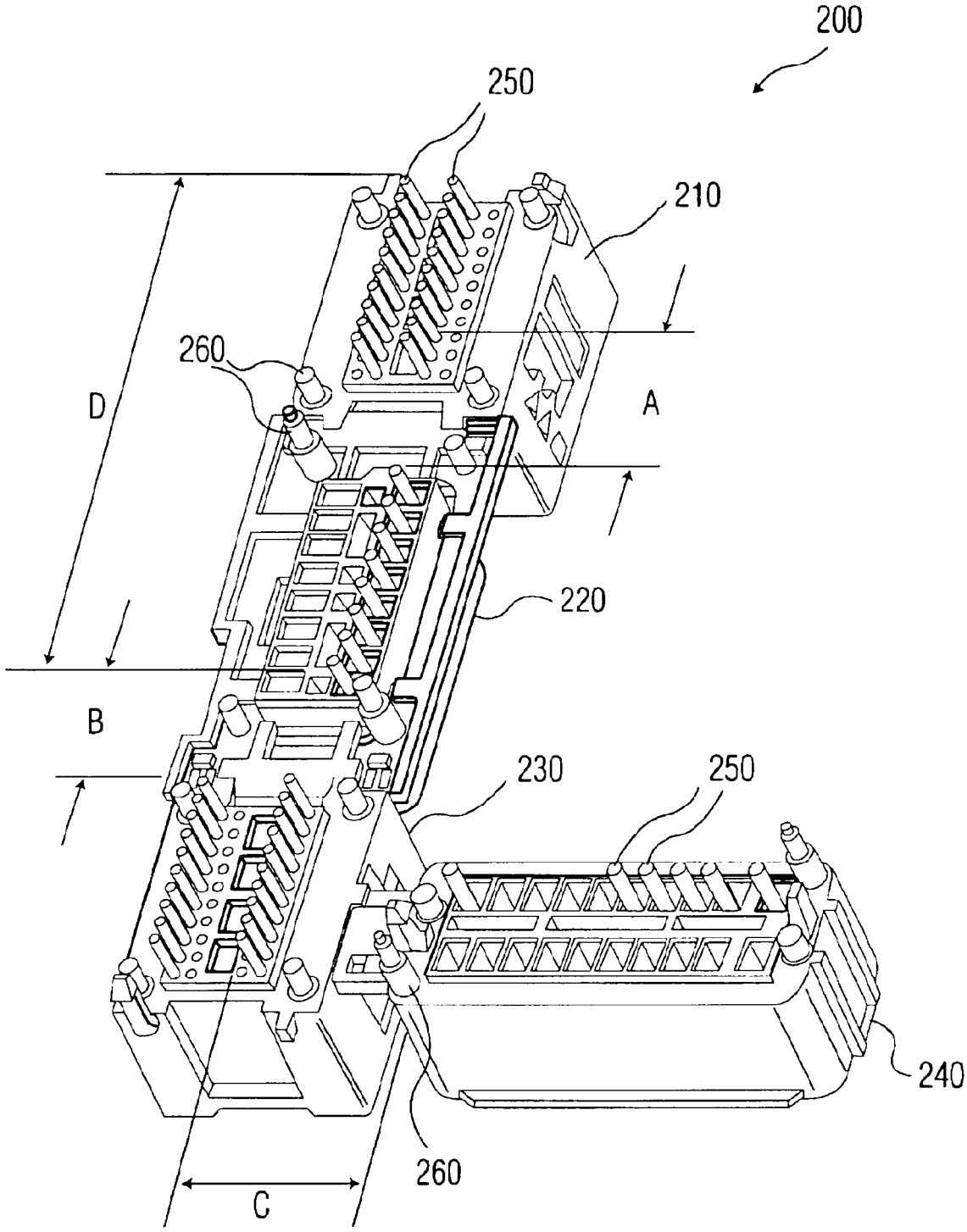
FIG. 2 illustrates an exemplary bottom perspective view of an adjustable pin header assembly, according to one embodiment of the present invention.

FIG. 2 illustrates an exemplary bottom perspective view of a moveable pin header assembly 200, according to one embodiment of the present invention. The header assembly 200 includes four separate headers 210, 220, 230, 240 in this embodiment that are connected together for assembly to a PCB. Each of the headers 210–240 includes contact pins 250 that are used to connect to the vias in the PCB, and may include guide pins 260 for aligning the header to the PCB, so that the contact pins 250 are in alignment with the vias in the PCB. As mentioned above, each of the headers 210–240 are preferably fabricated separately and then connected together prior to assembly to the PCB, such as prior to shipment to an assembler. The headers 210–240 are fabricated in such a way as to be movably connected to each other in a secure fashion, preferably in a longitudinal direction. An advantage of header assembly 200 in providing for adjustment between each of the headers 210–240 provides an assembler flexibility in the assembly process. That is, the assembler can move the headers 210–240 closer or further away from each other in order to align the contact pins 250.

Advantageously, the longitudinal adjustment of the headers 210–240 allows for compensation of any shrinking differences, which may occur during plastic parts injection, particularly in larger dimensions. In many embodiments, it is desirable to maintain certain defined pin distances so that all of the pins in the header assembly can align with the vias in the PCB. FIG. 2 illustrates examples of four pin distances (A, B, C, D) between various headers. Assuming in this embodiment that the top of FIG. 2 represents the top of each header and thus the first pin of each header, "A" represents the distance between the last pin of header 210 and the first pin of header 220, "B" represents the distance between the last pin of header 220 and the first pin of header 230, "C" represents the distance between the pins on the left of each of headers 210–230 and the pins of the right of the headers 210–230, and "D" represents the distance between the first pin of header 210 and the last pin of header 230 (the entire longitudinal distance of the pins on the headers extending upwardly).

Figure 3:
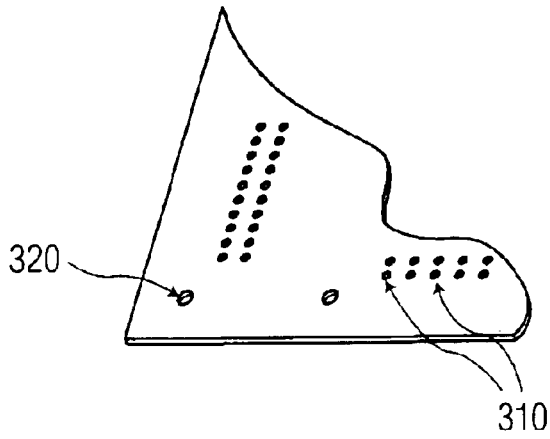
FIG. 3 illustrates an exemplary perspective view, partly broken away, of a PCB having vias and mounting holes, according to one embodiment of the present invention.

FIG. 3 illustrates an exemplary perspective view, partly broken away, of a PCB 300. The PCB 300 has vias 310 for connecting periphery (components, connections) to different elements of the PCB. The PCB 300 may also have mounting holes 320 for accepting mounting pins in the headers. The mounting holes 320 and associated mounting pins assist in the alignment of the contact pins with the vias 310.

Figure 4:
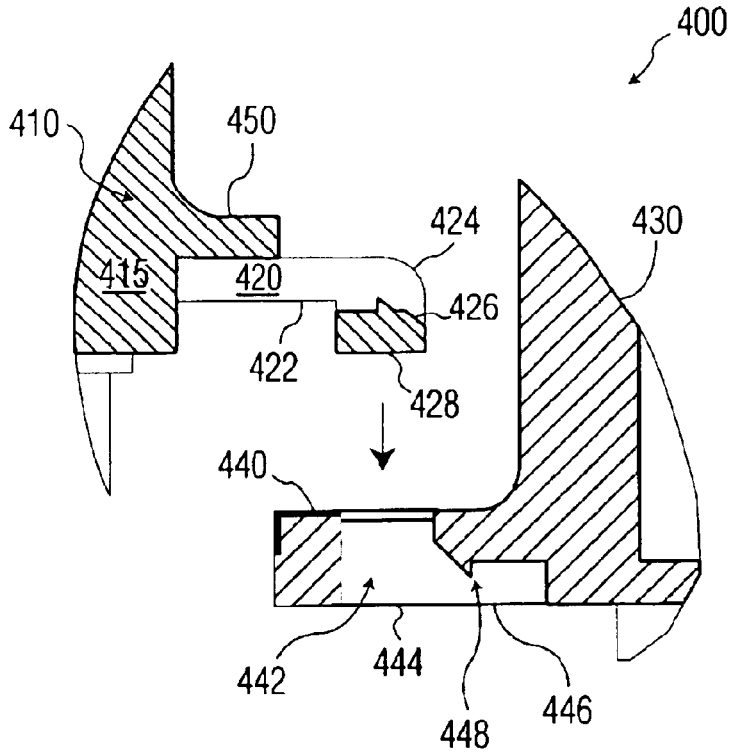
FIG. 4 illustrates an exemplary sectional view of unconnected headers of an adjustable pin header assembly, according to one embodiment of the present invention.

FIG. 4 illustrates an exemplary cross sectional view of an unassembled header assembly 400 at a connection point for two headers 410,430. A first header 410 includes a main body 415 and a retention arm 420 protruding from the main body 415. The retention arm 420 is configured in this embodiment generally in the shape of a sideways "J", with a longitudinal side 422 that extends from the housing 410, a bend 424, and a perpendicular side 426 that is substantially at a 90-degree angle from the longitudinal arm 422. The perpendicular side 426 includes a ridge 428 that extends therefrom. A second header 430 has a main body 435 and an extending surface 440 protruding from the main body 435. The extending surface 440 has an opening 442 formed therein, The opening 442 is configured in this embodiment generally in the shape of an "L", with a main shaft 444 and a lower shaft 446 extending from only the bottom of the main shaft 444. The extending surface 440 also includes a ridge 448 that extends into the lower shaft 446. The first housing 410 may also include a stop 450 located on top of the retention arm 420. The stop 450 is preferably wider than the retention arm 420, so as to prevent the retention arm 420 from entering too far into the opening 442.

To connect the headers in this embodiment, the perpendicular side 426 of the retention arm 420 is inserted in the main shaft 444 of the opening 442. Once the perpendicular side 426 is completely inserted in the main shaft 444, the retention arm 420 is moved in a longitudinal direction away from the first housing 410 (to the right as illustrated) so that the perpendicular side 426 enters the lower shaft 446. As the perpendicular side 426 is entering the lower shaft 446, the ridge 428 passes the ridge 448. The perpendicular side 426 can continue to be inserted in the lower shaft 446 until an outer edge of the perpendicular side 426 reaches an outer wall of the lower shaft 446 (stop point). The ridges 428, 448 engage one another (ridge contact point) when the retention arm 420 is retracted, so as to prevent the retention arm 420 from being removed from the opening 442 (retain the retention arm 420 within the opening 440). The retention arm 420 can be moved longitudinally within the opening 442 from the stop point to the ridge contact point. The distance between the ridge contact point and the stop point is the amount of movement that can be adjusted between the two headers. According to one embodiment, the distance is in the range of 0.5 mm or less. However, the distance is in no way intended to be limited thereto. Rather as one skilled in the art would recognize, the distance can be any amount required and/or desired to provide an assembler with flexibility in assembling the adjustable pin header assembly 400 to a PCB, and to take into account possible shrinkage of the headers that make up the assembly 400 during fabrication.

It should be noted that the retention arm 420 is in no way limited to the "J" shape and the opening 442 is in no way limited to the "L" shape as illustrated in FIG. 4. Rather, as one skilled in the art would recognize, there are multiple other embodiments that could be used to movably connect the headers that would be within the scope of the current invention.

Figure 5:
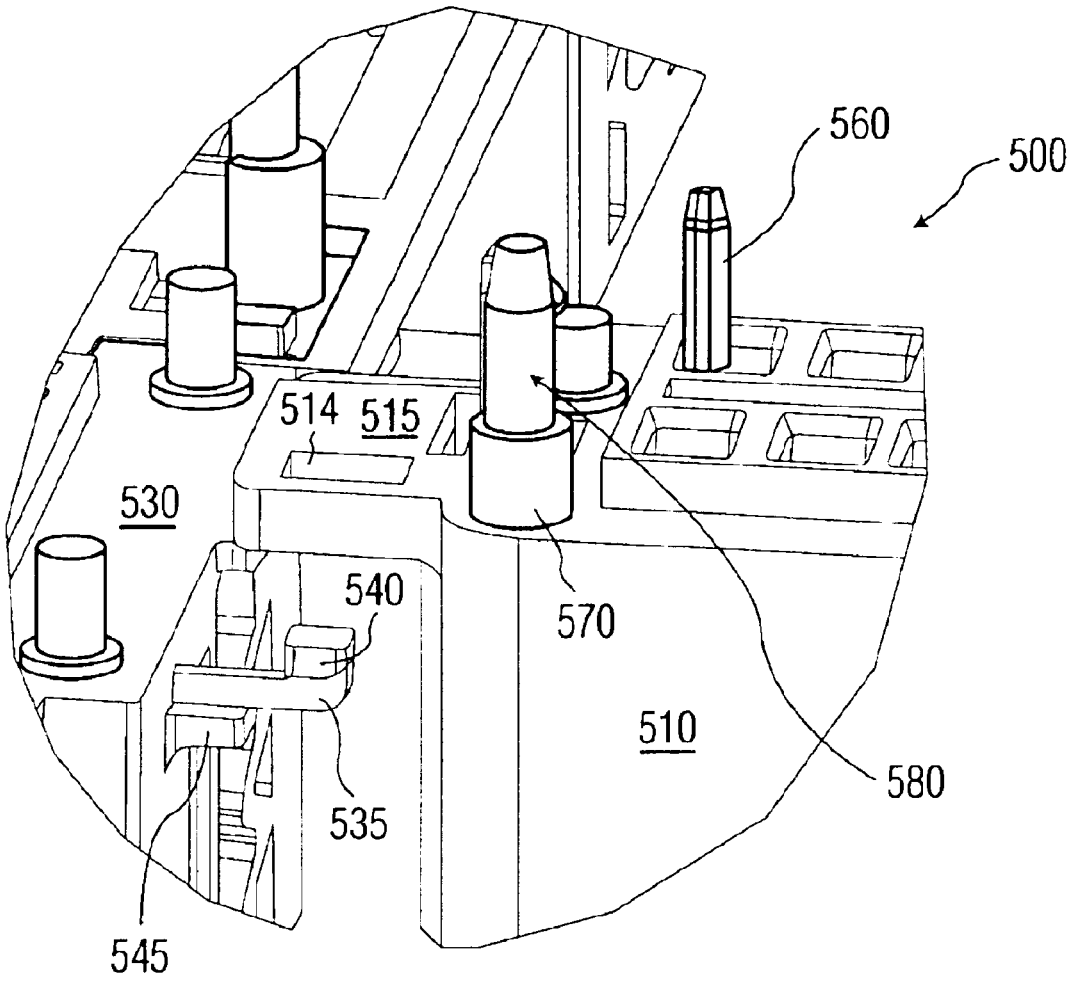
FIG. 5 illustrates an exemplary bottom perspective view, partly broken away, of unconnected headers of an adjustable pin header assembly, according to one embodiment of the present invention.

FIG. 5 illustrates an exemplary bottom perspective view, partly broken away, of two unassembled headers of a header assembly 500. A first header includes a main body 510 and an extension surface 515 having an opening 520 formed therein. The opening 520 includes a main shaft (not illustrated), a lower shaft (portion of the opening that is illustrated in FIG. 5), and a ridge (not illustrated) formed in the lower shaft. A second header includes a main body 530 and a retention arm 535 extending therefrom. The retention arm 535 includes a ridge 540 extending from the end. In order to moveably connect the headers to each other, the retention arm 535 is inserted in the main shaft of the opening 520 and is then slide into the lower shaft. The retention arm 535 is retained in the lower shaft by the ridge 540 engaging the ridge in the lower shaft (ridge contact point). The headers may be adjusted longitudinally with respect to each other from the ridge contact point to a point where the retention arm 535 abuts an end of the opening. The second header may also include a stop 545 protruding from the main body 530 and connecting to the retention arm 535. The stop 545 is preferably wider than the retention arm 535 in order to hold the retention arm 535 in the opening 520 (i.e., prevents the retention arm 535 from passing all the way through the opening 520). Each of the headers also has contact pins 560 and guide pins 570. Some of the guide pins 570 include a chamfer 580 at the end, which functions to guide the headers during assembly to a PCB.

It should be understood that the current invention is not limited to the illustrated embodiment of the exemplary movable pin header assembly 500 of FIG. 5, but could be modified in numerous manners that one of ordinary skill in the art would recognize without departing from the scope of the current invention. For example, as illustrated in FIG. 5, the header assembly 500 has a single retention arm 535 and a single opening 520 moveably connecting the two headers of assembly 500 together. According to one embodiment of the current invention, a plurality of retention arms and a plurality of openings in alignment with the retention arms could be used to moveably engage the two headers. Furthermore, as illustrated in FIG. 5, the retention arm 535 of the header assembly 500 is located above (appears below as illustrated since FIG. 5 is a bottom perspective view) the extension surface 515 and then bends downward towards the opening 520. According to one embodiment of the current invention, the retention arm 535 could be located below the extension surface 515 and bend up towards the opening 520.

Moreover, the retention arm 535 of the header assembly 500 extends from a relatively small portion of the main body 530 in FIG. S (i.e., has a small width) and the corresponding opening 520 therefore has a relatively small width. According to one embodiment, the retention arm 535 and the corresponding opening 520 could have a much larger width (i.e., extend from almost an entire side of the header). Additionally, as illustrated in FIG. 5, the retention arm 535 and the extension surface 515 of the header assembly 500 is located on the lower end of the headers (appears on the upper end as illustrated, since FIG. 5 is a bottom perspective view). According to one embodiment, the retention arm 535 and the extension surface 515 could extend from the top, side, or any combination of top, bottom and sides of the headers, as long as the retention arms 535 and the openings 520 are in alignment.

Figure 6:
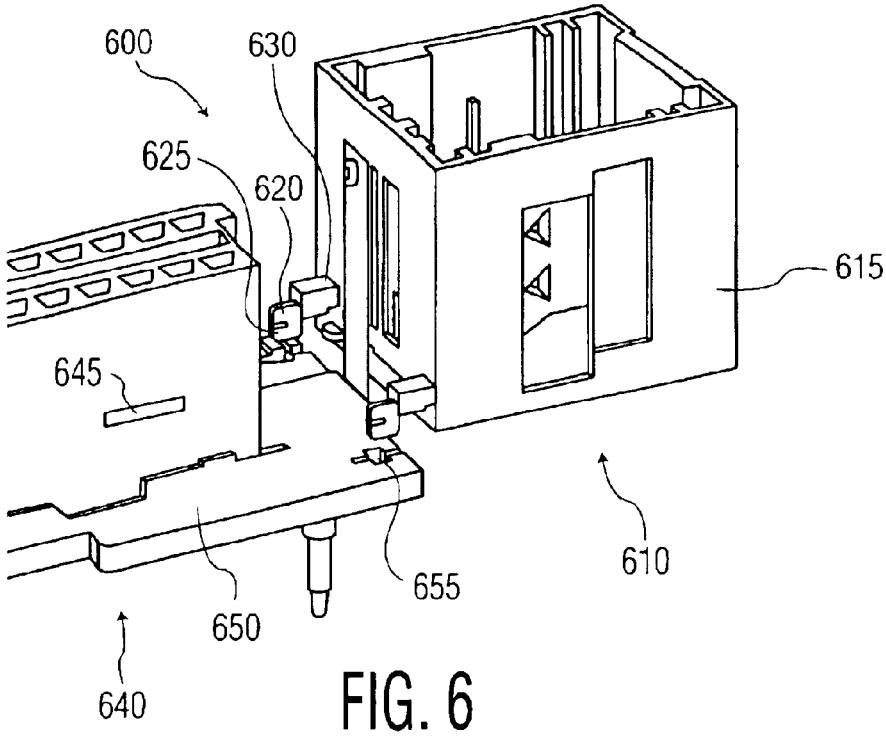
FIG. 6 illustrates an exemplary perspective view of unconnected headers of an adjustable pin header assembly, according to one embodiment of the present invention.

FIG. 6 illustrates an exemplary perspective view of two unassembled headers of a moveable pin header assembly 600. The header assembly 600 includes a first header 610 and a second header 640. The first header 610 has a main body 615 and two retention arms 620 extending from a lower edge of the main body 615. The retention arms 620 extend outward and then bend downward and include a ridge 625 extending in both directions proximate to the end of the downward section. The first header 610 further includes two stops 630 extending from the main body 615. The stops 630 are wider than the retention arms 620 and are located above and connected to a portion of the retention arms 620. The second header 640 has a main body 645 and an extending surface 650 extending from a lower edge of the main body 645. The extending surface 650 includes two openings 655 formed in an outer edge thereof The openings 655 are shaped like a "t" in this embodiment having a narrow beginning, a wider middle and a narrow end. The wider middle section is for receiving the ridges 625. The narrow beginning section is for receiving the retention arm 620 as the ridges 625 are inserted in the wider middle section. The narrow ending section is for receiving the retention arm 620 when the ridges 625 are inserted further into the opening in order to engage the ridges (not illustrated) within the opening 655. The ridges within the opening 655 and the ridges 625 engage one another and thus secure the two headers 610, 640 together. The ridges within the opening 655 are placed so as to provide the headers 610, 640 with sufficient longitudinal movement with respect to one another.

As should be understood, the present invention is not limited to the illustrated embodiment of the exemplary movable pin header assembly 600 of FIG. 6. Rather, the present invention could be modified in numerous manners that one of ordinary skill in the art would recognize, without departing from the scope of the current invention. For example, according to one embodiment, the ridge 625 could protrude from one side of the retention arm 620, only so that the wide middle section of the opening 655 would extend in one direction. According to one embodiment there could be additional (i.e., three or more) or less (i.e., one) retention arms 620 and openings 655. According to one embodiment, the retention arms 620 and the extension surface 650 and the openings 655 could extend from an upper surface, side surface(s), or some combination of upper, lower and side surfaces, as long as the retention arms 620 and the openings 655 are in alignment. It should also be noted that as illustrated, the extension surface 650 protrudes from all sides of the header 640. The invention is in no way intended to be limited thereto.

Figure 7:
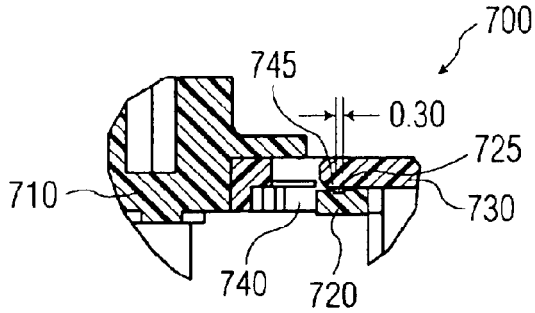
FIG. 7 illustrates an exemplary sectional view of connected headers of an adjustable pin header assembly, according to one embodiment of the present invention.

FIG. 7 illustrates an exemplary cross sectional view of an assembled header assembly 700 at a connection point for two headers 710, 730. A retention arm 720 that extends from a first header 710 is located within an opening 740 formed in a second header 730. The retention arm 720 is completely inserted in the opening 740, so an outer edge of the retention arm 720 is abutting an outer wall of the opening 740 (stop point). The retention arm 720 includes a ridge 725 that protrudes therefrom and the opening 740 includes a ridge 745 that protrudes thereinto. The ridges 725, 745 are formed so as engage one another (engagement point) and hold the retention arm 720 in the opening 740. The retention arm 720 can move longitudinally within the opening 740 from the engagement point to the stop point. As illustrated, the retention arm 720 has 0.3 mm of movement within the opening 740 in this embodiment (distance between ridge 725 when retention arm is abutted against outer wall of the opening 740 and the ridge 745). The illustrated amount of movement should in no way be construed to limit the scope of the current invention. Rather as should be understood by one of ordinary skill in the art, the amount of play can vary where needed or desired.

Figure 8:
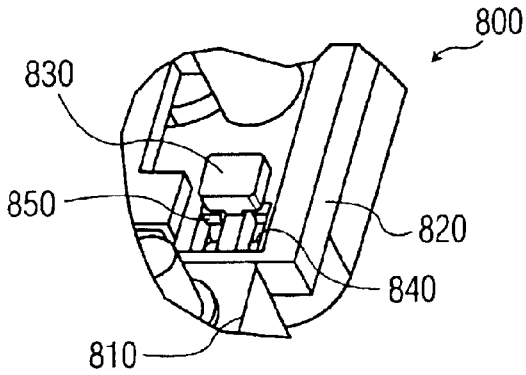
FIG. 8 illustrates an exemplary bottom perspective view, partly broken away, of connected headers of an adjustable pin header assembly, according to one embodiment of the present invention.

FIG. 8 illustrates an exemplary bottom perspective view, partly broken away, of two assembled headers of a header assembly 800. The header assembly 800 includes a first header 810 and a second header 820. The first header 810 includes a retention arm 830 that is mounted within an opening 840 in the second header 820. The opening 840 includes a ridge 850 that is locking the retention arm 820 within the opening 840.

Figure 9:
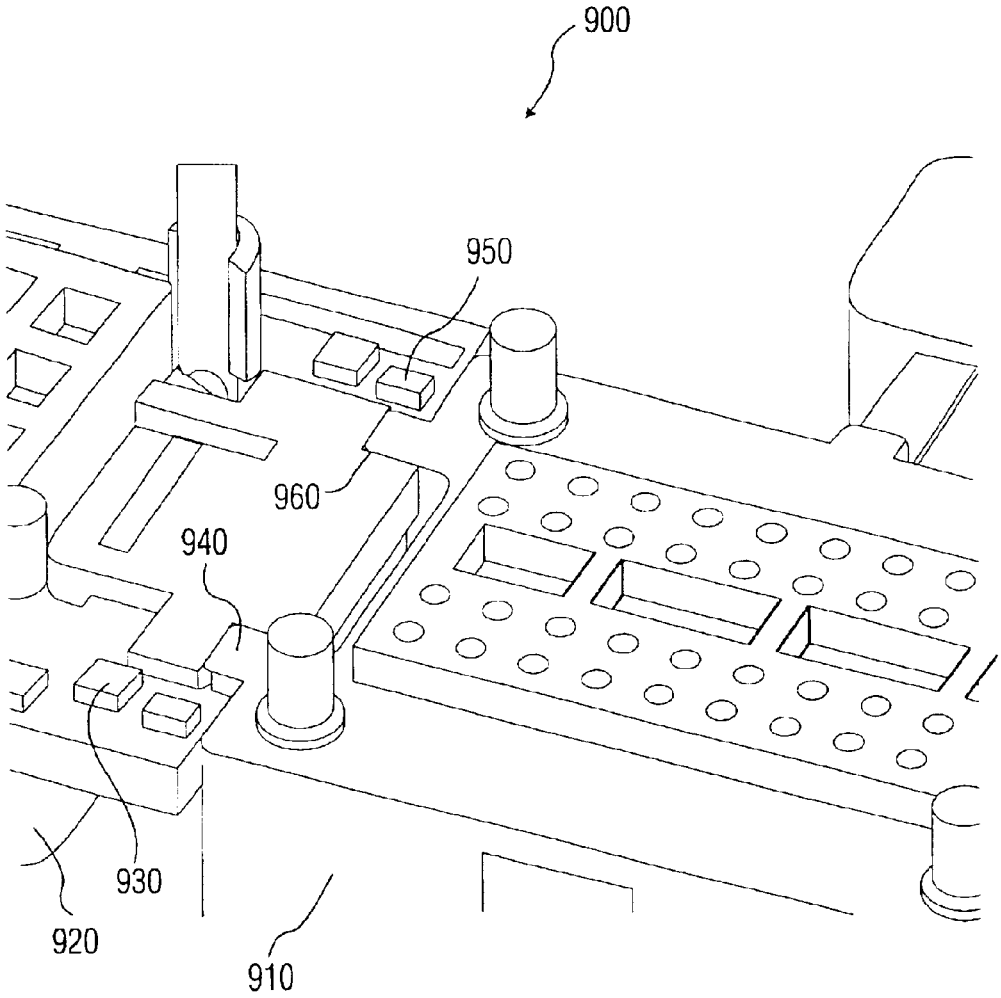
FIG. 9 illustrates an exemplary bottom perspective view of connected headers of an adjustable pin header assembly, according to one embodiment of the present invention.

FIG. 9 illustrates an exemplary bottom perspective view of two assembled headers) of a header assembly 900. The header assembly 900 includes a first header 910 and a second header 920. The first header 910 includes two retention arms 930, one located on each side of the housing, and two alignment tabs 940, one located in close proximity to each retention arm 930. The second housing 920 includes two openings 950 and two alignment groves 960 in close proximity to the openings 950. The alignment tabs 940 and the alignment groves 960 can be used to assist in aligning the two headers 910, 920 prior to connection (align the headers so that the retention arms 930 can be inserted in the openings 950) and after the connection (keep the headers from shifting to the left or right with respect to each other). While not illustrated in FIG. 9, there is preferably some type of latch mechanism included holding the retention arms 930 in the openings 950 (for example, ridges as previously discussed with respect to other embodiments).

As should be understood, the present invention is not limited to the illustrated embodiment of the exemplary movable pin header assembly 900 of FIG. 9, but could be modified in numerous manners that one of ordinary skill in the art would recognize. For example, as previously noted with respect to other embodiments, the header assembly 900 is not limited to two retention arms and two openings as illustrated. Moreover, the alignment tabs 940 and alignment groves 960 are not required, and if utilized, are not limited to being internal to the retention arms 930 and the openings 950 as illustrated. Rather, as one skilled in the art would recognize, the tabs 940 and grooves 960 may be located in numerous other locations without departing from the scope of the current invention. For example, according to different embodiments, the tabs 940/grooves 960 could be located external to, to the right of, to the left of, or on both sides of the retention arms 930/openings 950. According to one embodiment, a single tab 940/groove 960 could be located in the center between the two retention arms 930/openings. Moreover, as previously noted with respect to other embodiments, the retention arms 930 and the openings 950 are not limited to be along a lower surface of the headers 910, 920.

Figure 10:
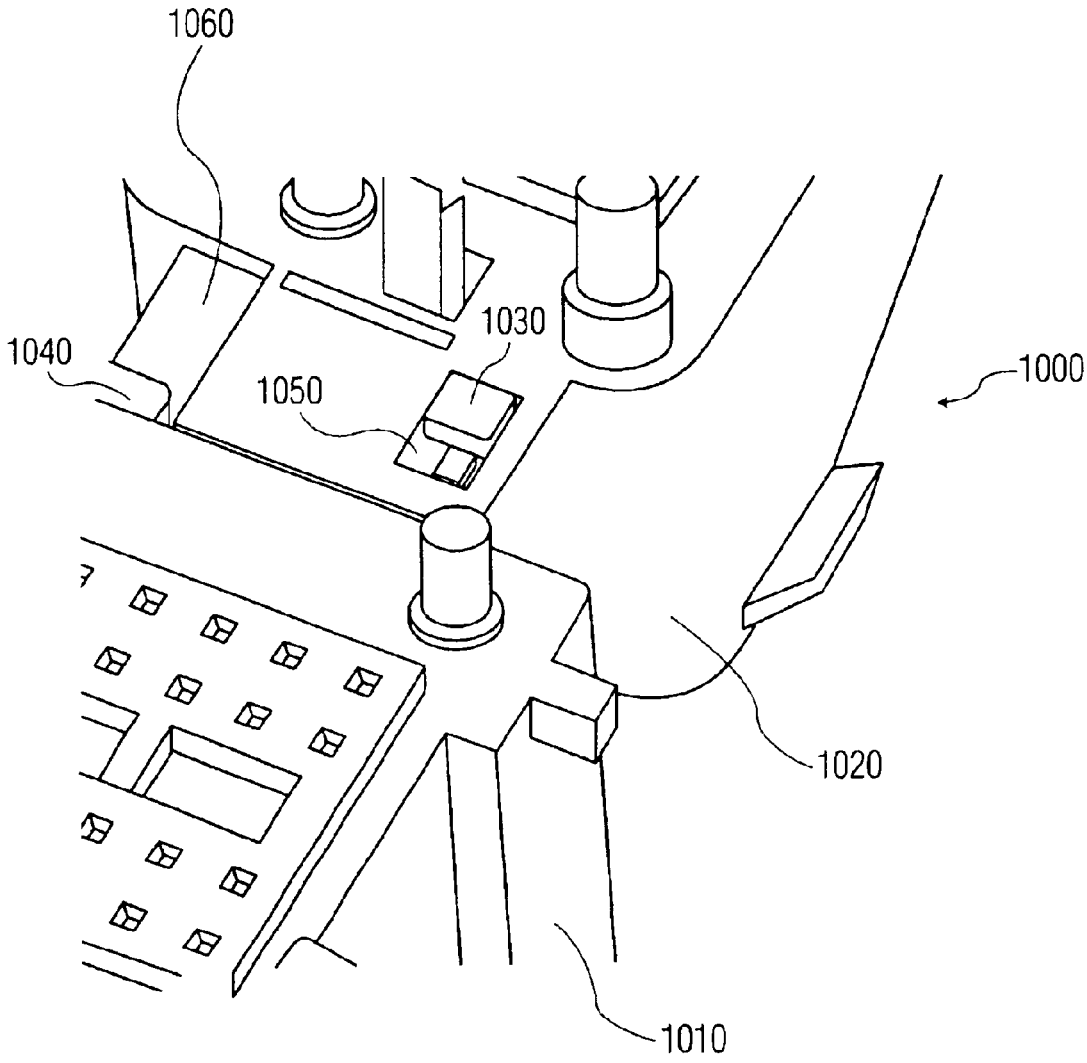
FIG. 10 illustrates an exemplary bottom perspective view of connected headers of an adjustable pin header assembly, according to one embodiment of the present invention.

FIG. 10 illustrates an exemplary bottom perspective view of two assembled headers of a header assembly 1000. The header assembly 1000 includes a first header 1010 and a second header 1020. The first header 1010 includes a retention arm 1030 located proximate to one side of the housing, and an alignment tab 1040 located proximate to the other side of the housing. The second header 1020 includes an opening 1050 located proximate to one side of the housing and an alignment recess 1060 located proximate to the other side of the housing. The alignment tab 1040 and the alignment recess 1060 can be used to assist in aligning the two headers 1010, 1020 prior to connection and restrict the headers 1010, 1020 from shifting to the left or right with respect to each other. While not illustrated in FIG. 10, preferably some type of latch mechanism (i.e., ridges on both the retention arm 1030 and in the opening 1050) is also provided in this embodiment for retaining the retention arm 1040 in opening 1050.

As should be understood, the current invention is not limited to the illustrated embodiment of the exemplary movable pin header assembly 1000 of FIG. 10. Rather, the current invention could be modified in numerous manners that one of ordinary skill in the art would recognize, without departing from the scope of the current invention. For example, according to one embodiment, additional retention arms 1030/openings 1050 could be utilized and/or additional alignment tabs 1040/aligmnent recesses 1060. According to one embodiment, the alignment tabs 1040/alignment recesses 1060 are located on each edge and the retention arm 1030/opening 1050 is located in the center. Moreover, as previously noted with respect to other embodiments, the retention arms 1030 and the openings 1050 are not limited to be along a lower surface of the headers 1010, 1020.

Figure 11:
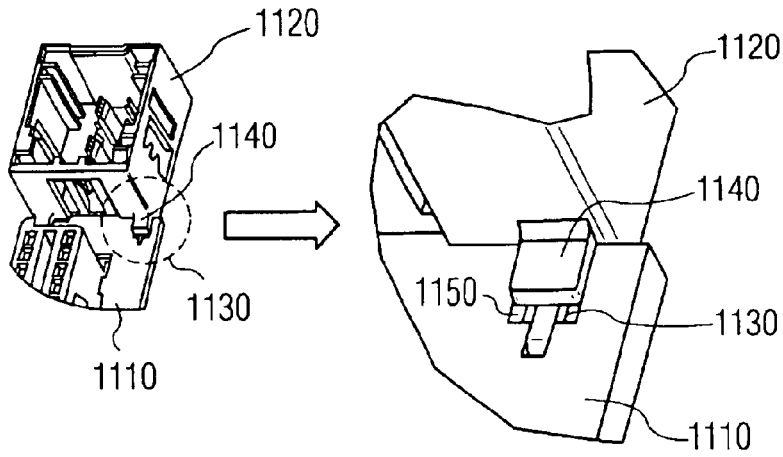
FIG. 11 illustrates an exemplary top perspective view, partly broken away, of connected headers of an adjustable pin header assembly, according to one embodiment of the present invention.

FIG. 11 illustrates an exemplary top perspective view, partly broken away, of two assembled headers of a header assembly 1100. The header assembly 1100 includes a first header 1110 and a second header 1120. The first header 1110 has an opening 1130 for receiving a retention arm 1150 of the second header 1120. The second header 1120 also has a stop 1140 that is wider than the retention arm 1150 connected above the retention arm 1150. The stop 1140 prevents the retention arm 1150 from passing completely through the opening 1130. As illustrated, the stop 1140 is sitting on top of the opening 1130 and the retention arm 1150 is located within the opening 1130. As should be understood, the current invention is not limited to the illustrated embodiment of the exemplary movable pin header assembly 1100 of FIG. 11, but could be modified in numerous manners that one of ordinary skill in the art would recognize.

Figure 12:
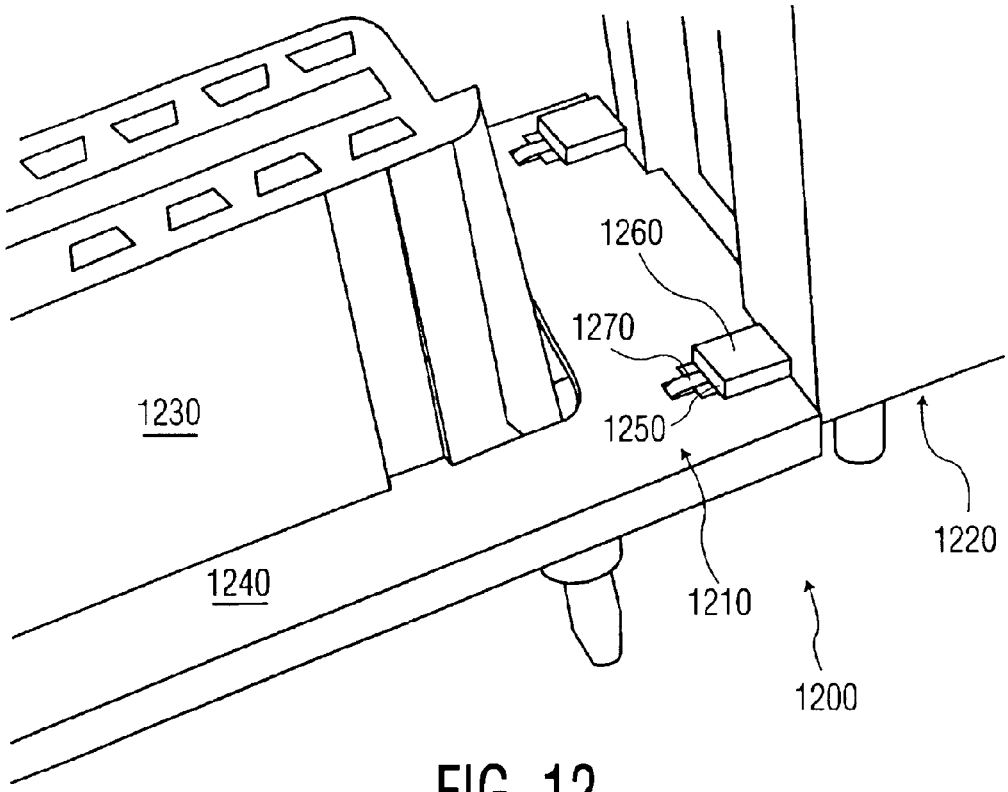
FIG. 12 illustrates an exemplary perspective view of connected headers of an adjustable pin header assembly, according to one embodiment of the present invention.

FIG. 12 illustrates an exemplary top perspective view of two assembled headers of a header assembly 1200. The header assembly 1200 includes a first header 1210 and a second header 1220. The first header 1210 includes a main body 1230 and an extending surface 1240 having an opening 1250 formed therein. The second header 1220 includes a retention arm 1270 extending therefrom and a stop 1260 that is wider than the retention arm 1270 connected above the retention arm 1270. The opening 1250 is designed to receive the retention arm 1270 and lock the headers 1210, 1220 together and allow for movement in the longitudinal direction. The stop 1260 prevents the retention arm 1270 from passing completely through the opening 1250. As illustrated, the stop 1260 is sitting on top of the opening 1250 and the retention arm 1270 is located within the opening 1250.

As should be understood, the current invention is not limited to the illustrated embodiment of the exemplary movable pin header assembly 1200 of FIG. 12, but could be modified in numerous manners that one of ordinary skill in the art would recognize. For example, according to one embodiment there could be additional (i.e., three or more) or less (i.e., one) retention arms 1270 and openings 1250. According to one embodiment, the retention arms 1270 and the extension surface 1240 and the openings 1250 could extend from an upper surface, side surface(s), or some combination of upper, lower and side surfaces, so long as the retention arms 1270 and the openings 1250 are in alignment. It should also be noted that as illustrated, the extension surface 1240 protrudes from all sides of the header 1210, however, the invention is in no way intended to be limited thereto.

The above-described embodiments of various movable pin header assemblies all include retention arms on one header and openings for receiving the retention arms on the other header. As should be understood, the invention is no way intended to be limited thereto. For example, one header may have a retention arm on a first side and a opening on a second side and the other header may have an opening on a first side and a retention arm on a second side. The retention arm/opening on the first side and the opening/retention arm on the second side would be in alignment to allow connection to each other. Furthermore, a retention arm (male connection mechanism) and an opening (female connection mechanism) are not the only devices that can be used to moveably attach two headers. Rather, any type of attachment mechanism that can be fabricated as a part of the headers, and which allows the headers to longitudinally move with respect to one another, could be used. For example, according to one embodiment, a female connection mechanism need not consist of an opening formed in an extension surface (as illustrated in many of the above described embodiments). Rather, the female connection mechanism could be an opening formed directly in the housing of the header. According to one embodiment, the male connection mechanism need not bend (as illustrated in many of the above described embodiments). Rather, the male connection mechanism could be an extension arm extending from the housing of the header that has, for example, serrated edges formed therein that allow the extension arm to be inserted into an opening but not removed therefrom.

The headers utilized in connection with the various embodiments of moveable pin header assemblies disclosed herein may be specially designed and fabricated for each PCB where desired. That is the layout of the PCB will dictate not only the size, shape and pin layout of the headers, but also the type of connection mechanism fabricated in each. Alternatively, different headers for receiving different periphery may have standard connection mechanisms formed therein, and the PCB designed and laid out in such a fashion as to take advantage of the standard connection mechanisms of the different headers. For example, some headers may be designed to be placed in the corners of the PCBS. Alternatively, all headers may be designed to have standard connection mechanisms formed therein (i.e., a male connector on one side and a female connector of the other side).

While the invention has been described by illustrative embodiments, additional advantages and modifications will occur to those skilled in the art. Therefore, the invention in its broader aspects is not limited to specific details shown and described herein. Modifications may be made without departing from the spirit and scope of the invention. Accordingly, it is intended that the invention not be limited to the specific illustrative embodiments, but be interpreted within the full spirit and scope of the appended claims and their equivalents.

What is claimed is:

1. A connector assembly comprising:

a first housing having a retention arm, said retention arm including a longitudinal portion and a perpendicular portion, said perpendicular portion including a first serrated ridge; and a second housing having an opening for receiving the retention arm, said second housing including a second serrated ridge within the opening, said retention arm being moved initially to a first direction in said opening and then in a different second direction in said opening, wherein the first ridge and the second ridge move toward and then past one another, so as to be fixedly engaged to hold the retention arm in the opening, wherein the first housing and the second housing each have a lower side for connecting to a printed circuit board (PCB), wherein at least one of the lower sides includes non-electrically conductive guide pins for aligning the first housing and the second housing with the PCB; and, wherein the retention arm can move longitudinally within the opening from a point where the first serrated ridge and the second serrated ridge engage to a point where the retention arm abuts an end of the opening so as to ensure the proper alignment of the guide pins with the PCB.

2. The assembly of claim 1, wherein the first housing and the second housing are moveably connected in a longitudinal direction.

3. The assembly of claim 1, wherein the lower sides include contact pins for providing connectivity to the PCB.

4. The assembly of claim 1, wherein said second housing further includes a guide for aligning the first housing and the second housing.

5. The assembly of claim 1, wherein said first housing further includes a guide for aligning the first housing and the second housing.

6. The assembly of claim 1, wherein said first housing further includes a stop for keeping the first serrated ridge aligned with the second serrated ridge.

7. The assembly of claim 1, wherein the retention arm includes a plurality of retention arms and the opening includes a plurality of openings, wherein each retention arm is mounted in an associated opening.

8. An adjustable pin header assembly for mounting to a printed circuit board (PCB), said assembly accepting peripheral circuit elements and providing connectivity between the peripheral circuit elements and the PCB, the assembly comprising at least one first header having an upper side for receiving a first set of peripheral circuit elements, a lower side having contact pins and guide pins extending therefrom in alignment with corresponding vias in the PCB, and a female connection mechanism; and at least one second header having an upper side for receiving a second set of peripheral circuit elements, a lower side having contact pins and non-electrically conductive guide pins extending therefrom in alignment with corresponding vias in the PCB, and a male connection mechanism;

wherein the at least one second header is secured to the at least one first header by mounting the male connection mechanism in the female connection mechanism, wherein the male connection mechanism comprises a retention arm including a longitudinal portion and a perpendicular portion, said perpendicular portion including a first serrated ridge, wherein the female connection mechanism comprises an opening for receiving the retention arm, said opening including a second serrated ridge therein, said retention arm of said male connection mechanism being moved initially in a first direction in said opening and then in a different second direction in said opening, wherein the first serrated ridge and the second serrated ridge move toward and then past one another, so as to be fixedly engaged to hold the retention arm in the opening; and, wherein the retention arm can move longitudinally within the opening from a point where the first serrated ridge and the second serrated ridge engage to a point where the retention arm abuts an end of the opening so as to ensure the proper alignment of the guide pins of the at least one first and second headers with the PCB.

9. The assembly of claim 8, wherein the at least one first header and the at least one second header can move longitudinally with respect to one another.

10. The assembly of claim 8, wherein the male connection mechanism can move longitudinally within the female connection mechanism.

11. A printed circuit board (PCB) assembly comprising a PCB; and a movable pin header assembly connected to the PCB, wherein the movable pin header assembly includes a first header having a male connection mechanism formed therein and a second header having a female connection mechanism formed therein and the first header and the second header are mounted together, wherein the first header and the second header each have a lower side for connecting to the PCB, wherein at least one of the lower sides includes non-electrically conductive guide pins for aligning the first header and the second header with the PCB, wherein the male connection mechanism comprises a retention arm including a longitudinal portion and a perpendicular portion, said perpendicular portion including a first serrated ridge, wherein the female connection mechanism comprises an opening for receiving the retention arm, said opening including a second serrated ridge therein, wherein the first serrated ridge and the second serrated ridge fixedly engage one another to hold the retention arm in the opening; and, wherein the retention arm can move longitudinally within the opening from a point where the first serrated ridge and the second serrated ridge engage to a point where the retention arm abuts an end of the opening so as to ensure the proper alignment of the guide pins of the first and second headers with the PCB.

12. The assembly of claim 11, wherein said PCB includes vias and said movable pin header assembly includes pins in alignment with the vias.

13. The assembly of claim 12, wherein the first header and the second header can move longitudinally with respect to one another prior to connection to the PCB to allow for alignment of the pins and the vias.

14. A method for manufacturing an adjustable pin header assembly, the method comprising:

fabricating a plurality of headers, wherein at least a first subset of the plurality of headers include a female connection mechanism and at least a second subset of the plurality of headers include a male connection mechanism; and connecting at least a first header having a male connection mechanism to at least a second header having a female connection mechanism, wherein the first header and the second header can move longitudinally with respect to each other, wherein the first subset of the plurality of headers and the second subset of the plurality of headers each have a lower side for connecting to a printed circuit board (PCB), wherein at least one of the lower sides includes non-electrically conductive guide pins for aligning the first subset of the plurality of headers and the second subset of the plurality of headers with the PCB, wherein the male connection mechanism comprises a retention arm including a longitudinal portion and a perpendicular portion, said perpendicular portion including a first serrated ridge, wherein the female connection mechanism comprises an opening for receiving the retention arm, said opening including a second serrated ridge therein, said retention of said male connection mechanism being moved initially in a first direction in said opening and then in a second direction in said opening substantially perpendicular to the first direction, wherein the first serrated ridge and the second serrated ridge move toward and then past one another in the second direction to fixedly engage one another to hold the retention arm in the opening; and, wherein the retention arm can move longitudinally within the opening from a point where the first serrated ridge and the second serrated ridge engage to a point where the retention arm abuts an end of the opening so as to ensure the proper alignment of the guide pins of the at least one first and second headers with the PCB.

15. The method of claim 14, wherein the male connection mechanism can move within the female connection mechanism to allow the first header to move longitudinally with respect to the second header.

16. The method of claim 14, wherein each of the plurality of headers is fabricated independently of each other.

17. The method of claim 14, wherein said fabricating includes fabricating a housing for each of the headers, wherein each of the housings include receptacles for receiving pins; and inserting pins in appropriate receptacles in the housings, wherein the pins are used to connect the headers to a printed circuit board.

18. The method of claim 14, wherein said connecting includes inserting the retention arm in the opening until the first serrated ridge passes the second serrated ridge.

19. The method of claim 18, wherein the retention arm can move within the opening from a point where the first serrated ridge and the second serrated ridge engage to a point where the terminating end of the retention arm abuts a terminating end of the opening.

* * * * *